US005476044A

United States Patent [19]

Boucher

[11] Patent Number: 5,476,044

[45] Date of Patent: Dec. 19, 1995

[54] ELECTRONIC SAFE/ARM DEVICE

[75] Inventor: Craig J. Boucher, Simsbury, Conn.

[73] Assignee: The Ensign-Bickford Company, Simsbury, Conn.

[21] Appl. No.: 323,155

[22] Filed: Oct. 14, 1994

[51] Int. Cl.[6] ..... F42C 11/00; F23Q 7/02

[52] U.S. Cl. ..... 102/218; 102/206

[58] Field of Search ..... 102/200, 206, 102/218, 219, 220

[56] References Cited

U.S. PATENT DOCUMENTS

| | | | |
|---|---|---|---|
| 3,171,063 | 2/1965 | Hutchison et al. . | |
| 3,624,451 | 11/1971 | Gauld | 102/218 |
| 3,670,653 | 6/1972 | Lunt et al. | 102/218 |
| 3,671,842 | 6/1972 | McKeown | 102/218 |
| 4,136,617 | 1/1979 | Fowler | 102/220 |
| 4,141,297 | 2/1979 | Sellwood . | |
| 4,246,845 | 1/1981 | Winton et al. . | |
| 4,422,378 | 12/1983 | Plichta . | |
| 4,422,379 | 12/1983 | Geller et al. . | |
| 4,646,640 | 3/1987 | Florin et al. | 102/200 |
| 4,651,646 | 3/1987 | Foresman et al. | 102/218 |
| 4,700,263 | 10/1987 | Marshall et al. . | |
| 5,341,742 | 8/1994 | Alford et al. | 102/218 |

FOREIGN PATENT DOCUMENTS

| | | |
|---|---|---|
| 2096415 | 10/1982 | United Kingdom . |
| 2132041 | 6/1984 | United Kingdom . |
| 2138576 | 10/1984 | United Kingdom . |

*Primary Examiner*—Charles T. Jordan
*Assistant Examiner*—Theresa M. Wesson
*Attorney, Agent, or Firm*—Victor E. Libert; Frederick A. Spaeth

[57] ABSTRACT

An electronic safe/arm device is powered internally by a low-voltage, periodic power source that has insufficient voltage by itself to fire the detonator. The circuit therefore includes a step-up transformer from which sufficient voltage to fire the detonator is obtained. The step-up transformer charges an arming circuit which stores high-voltage power to fire the detonator and also powers the firing circuit which discharges the stored high-voltage energy through the detonator at the appropriate time, to fire the device. The low-voltage, periodic power source may include a low-voltage battery and a dynamic switch for providing periodic pulses of low-voltage energy to the primary winding of the transformer, and the dynamic switch may be powered from the output of the transformer, so that the low-voltage battery has insufficient voltage to power the dynamic switch. Accordingly, high-voltage energy derived from the output of the transformer is required to operate the circuit, providing assurance that the device will not fire if the circuit is damaged.

12 Claims, 4 Drawing Sheets

ELECTRONIC SAFE/ARM DEVICE

BACKGROUND OF THE INVENTION

1. Field of the Invention

This invention relates to a safe/arm device for controlling the firing of explosive charges, and more particularly to electronic safe/arm firing devices having internal power supplies.

It is currently commonplace to employ electronic safe/arm circuitry to control the firing of explosive charges such as those used in ordnance. Such circuitry often comprises isolation transformers between a power source and the detonator to inhibit the firing of the explosive charge in the event that the power source is inadvertently directly connected to the detonator. However, the prior art devices fail to teach how to safely power the firing circuitry that controls the firing of the device.

2. Related Art

U.S. Pat. No. 4,700,263 to Marshall et al, dated Oct. 13, 1987 discloses a safe/arm system in which a low power source (10) charges a bank of capacitors (C1)–(C8). After a suitable delay determined by a microprocessor (13), the charge stored in the capacitors is stepped-up through a transformer (T1) to charge a high-voltage capacitor (12) in a step-wise manner. When sufficiently charged, capacitor (12) initiates a munition charge by means of an exploding foil or exploding bridgewire. The capacitors do not power the microprocessor, and there is no firing switch operated off the transformer.

U.S. Pat. No. 4,651,646 to Foresman et al, dated Mar. 24, 1987 discloses a safe and arm circuit for use with a slapper detonator. In this circuit, a capacitor (32) is charged from a power source such as an air generator (30). The voltage from the capacitor (32) is stepped-up through a flyback transformer (35) through a switch (33) controlled by a microprocessor (37). Thus, the power from capacitor (32) is stepped-up to charge a detonator capacitor (40). At the desired time, microprocessor (37) actuates a switch (42) to fire the slapper detonator using the high-voltage stored in detonator capacitor (40). There is no teaching with respect to the source of power for the microprocessor.

U.S. Pat. No. 4,136,617 to Fowler, dated Jan. 30, 1979 discloses an electronic delay detonator in which an arming signal is applied to a safety circuit which steps-down the voltage and charges a firing circuit capacitor. When a firing pulse is applied to a triggering circuit, the timer is initiated, and after the selected time period, the timer sends a firing signal to the firing circuit to allow the firing capacitor to discharge through the detonator. There is no internal source of power for the circuitry that controls the charging and firing of the circuit.

SUMMARY OF THE INVENTION

The present invention relates to an electronic arming device comprising the following components. There is an internal, low-voltage, periodic power means for providing periodic pulses of low-voltage electricity. A transformer comprising a primary winding is operably connected to the periodic power means and comprises at least one secondary winding for producing output voltage from the periodic pulses in the primary winding, including high-voltage AC power. A high-voltage arming means is operably connected to the at least one secondary winding of the transformer, for storing high-voltage electrical energy from the transformer for use in firing the high-voltage detonator defined below. A high-voltage detonator is operably connected to the arming means and a firing means powered from the output of the transformer. The firing means fires the detonator after the arming means is charged by the transformer by discharging to the detonator the energy stored in the arming means.

According to one aspect of the invention, the periodic power means may comprise a low-voltage battery means and a dynamic switch means for periodically discharging the low-voltage battery means through the primary winding in response to an arm signal from an external source or from the output of the transformer, and for stopping the periodic discharge in the absence of the arm signal. Optionally, the periodic power means may comprise enabling means for operably connecting the periodic power means to the primary winding of the transformer in response to receipt by the enabling means of an enable signal, and for operably disconnecting the periodic power means from the primary winding to prevent the periodic power means from discharging through the transformer upon at least one of (a) receipt of a disarm signal and (b) the absence of an enable signal.

According to another aspect of the invention, the arming means may comprise signal-generating means powered from a secondary winding of the transformer and operably connected to at least one of the enabling means and the dynamic switch means, for producing at least one of an arm signal and an enable signal.

According to still another aspect of the invention, the firing means may comprise a timer means that is responsive to an arm command or to a trigger signal, for measuring a predetermined delay period following the arm signal or trigger signal and for issuing a signal thereafter. The firing means fires the detonator in response to the signal from the timer means. Optionally, there may be a pressure switch for providing a trigger signal to the timer.

According to yet another aspect of the invention, the arming means may comprise a high-voltage capacitor operably connected to the detonator.

Optionally, the arming means may comprise relay means for connecting the detonator to the arming means in response to power output from the transformer and for disconnecting the detonator from the arming means in the absence of output from the transformer.

In a particular embodiment, an electronic safe/arm device according to the present invention may comprise the following components: An internal, low-voltage, battery means; a transformer operably connected to the battery means, the transformer comprising a primary winding and at least one secondary winding for producing output voltage including high-voltage AC power from low-voltage pulses in the primary winding; a dynamic switch means for periodically discharging the battery means through the primary winding in response to an arm signal, and for stopping the periodic discharge in the absence of an arm signal; an internal signal-generating means powered from the output of the transformer and operably connected to the dynamic switch means, for producing at least an arm signal; a high-voltage arming means operably connected to the at least one secondary winding of the transformer, for storing high-voltage energy from the transformer; and a high-voltage detonator operably connected to the arming means. It may also comprise a firing means powered from the internal signal-generating means for discharging the arming means through the detonator after a predetermined delay following an arm signal or a trigger signal. There may also be power-enable means for operably connecting the battery means to the transformer in response to an enable signal, and for stopping the periodic discharge of the battery means to the primary winding of the transformer upon at least one of (a) the absence of an enable signal and (b) the receipt of a disable signal.

Optionally, the power-enable means may be responsive to an enable signal that follows a disable signal, to allow the periodic discharge of the battery means through the primary winding of the transformer to resume after such discharge has been stopped due to the receipt of the disarm signal.

Optionally, the internal signal-generating means may be operably connected to the power-enable means, to provide an enable signal to the power-enable means from the output of the transformer.

In another embodiment, the detonator may be connected to the arming means by a normally open relay that closes in response to the arm signal from the internal arm signal means.

As used herein and in the claims to describe a relationship between two or more devices, the phrase "operably connected" shall be construed to include both a direct, constant electrical connection and connection through an intervening device, such as a switch, that provides, under prescribed conditions, an electrical connection so that the devices can function together as intended.

DETAILED DESCRIPTION OF THE INVENTION AND PREFERRED EMBODIMENT THEREOF

The present invention relates to an improved safe/arm firing device circuit which contains an electric detonator and an internal, low-voltage, periodic power source to power the circuit so that the detonator can be fired without the need to connect the circuit to an external power source after the circuit is armed. Generally speaking, the internal power source is used to charge the arming circuit to prepare the device for firing. Firing is achieved by discharging the arming circuit through the detonator, which can be used to set off an explosive charge in a wide variety of applications, including, e.g., demolition charges and ordnance.

One of the features of the present invention is that the internal power source is linked to the other components of the circuit, e.g., to the arming circuit, through a transformer that isolates the internal power source from the remaining circuitry. Also, the internal power source is of insufficient voltage to fire the detonator directly. Accordingly, the transformer is used not only to isolate the internal power source from the detonator but it must also step-up the voltage of the internal power source to arm the device. Another feature of the present invention is that the firing circuit, which controls the release of energy from the arming circuit to fire the ordnance, requires a high-voltage source of power for its operation, and the internal power source is of insufficient voltage to power the firing circuit. Nevertheless, no external power source is necessary because the firing circuit is, like the arming circuit, powered from the output of the transformer. Thus, the safe/arm firing circuitry according to the present invention provides a significant degree of safety against inadvertent firing should the internal power source be unintentionally connected to any one or more of the detonator, the arming circuit or the firing circuit, as may occur if, for example, the device were to be short-circuited. As will be discussed below, the firing circuit of the present invention may comprise several other additional safety features. For example, the device may be configured so that one or more preferably high-voltage signals, such as an enable signal and/or an arm signal, must be received before the low-voltage power source can be stepped-up through the transformer to prepare the circuit for firing. Also, the detonator may be connected to the arming circuit through a normally open relay which only closes when powered from the output of the transformer.

Figure 1:
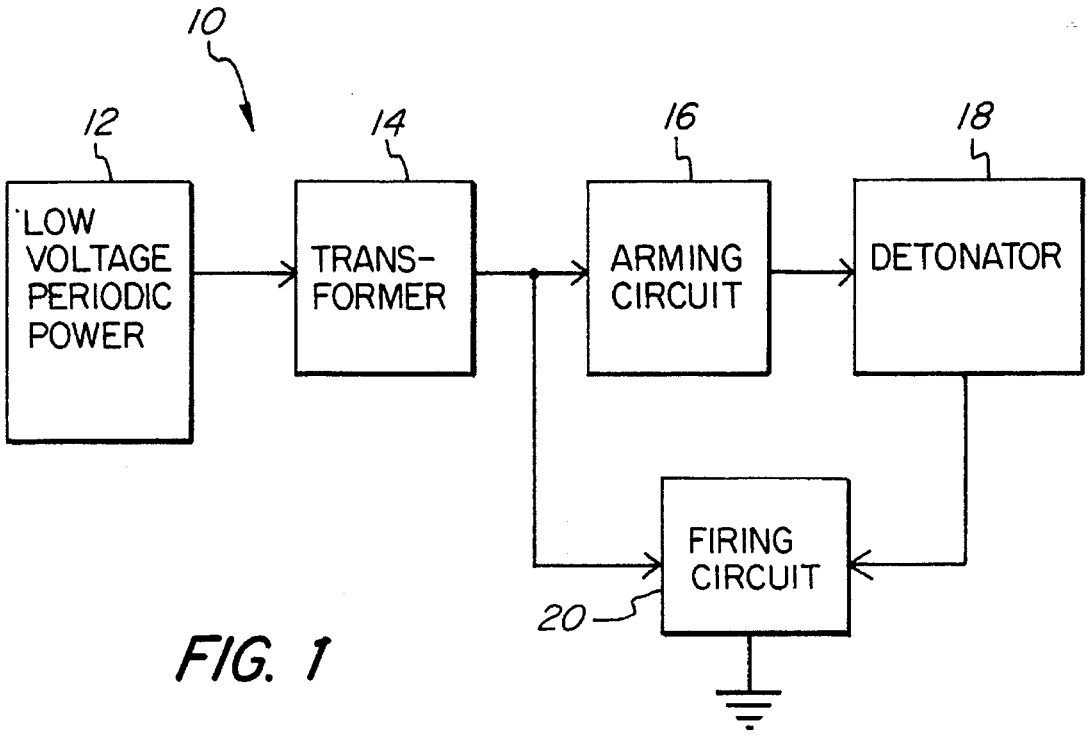
FIG. 1 is a schematic block diagram of a safe/arm firing circuit according to one embodiment of the present invention.

FIG. 1 shows the general relationship between various components of a safe/arm device 10 according to one embodiment of the present invention. As shown in FIG. 1, the circuitry comprises an internal low-voltage periodic power source 12. The term "low-voltage" as used herein and in the claims is a relative term that characterizes the voltage output of the internal periodic power source as being insufficient to charge the arming circuit, to fire the detonator or to operate the firing circuit, etc., which are referred to, conversely, as "high-voltage" components. In a particular embodiment, the voltage of the low-voltage periodic power source may be about 3 volts, whereas the voltage required to fire the detonator, charge the arming circuit and operate the firing circuit may be, for example, about 12 volts.

The internal low-voltage periodic power source 12 is operably connected to, and discharged through, the primary winding of a transformer 14, which comprises at least one secondary winding to step-up the low-voltage power of power source 12 to a voltage adequate to power the remainder of the circuit. An arming circuit 16 derives and stores high-voltage power from the output of transformer 14. Arming circuit 16 is operably connected to detonator 18 so that the high-voltage power stored in arming circuit 16 can be discharged through detonator 18 to fire the detonator, which is placed in close proximity to the explosive charge and in turn detonates the explosive charge. Such discharge is controlled by a firing circuit 20 which, as shown, derives its power from the output of transformer 14 as does arming circuit 16.

One embodiment of a safe/arm firing circuit generally described in connection with FIG. 1 can be understood with reference to FIG. 2. The low-voltage periodic power source 12 comprises a low-voltage internal battery 120 which preferably provides an output of about 3 volts. Internal battery 120 is operably connected to the primary winding 140 of isolation transformer 14 by an optional arm-enable switch 122 and an optional power-enable switch 124. When arm-enable switch 122 and power-enable switch 124 are closed, battery 120 can be discharged through primary winding 140 by closing a dynamic switch 126 that is operated by dynamic switch control 128. The periodic opening and closing of dynamic switch 126 yields periodic low-voltage power pulses from battery 120 to primary winding 140 of transformer 14. The arm-enable switch 122 closes upon receipt of an arm command, and power-enable switch 124 is closed by controller 130 in response to an enable command. Arm-enable switch 122 and controller 130 are high-voltage components, so the arm command and the enable command must be high-voltage signals, which cannot be obtained directly from battery 120. Therefore, these signals must be obtained from an external source or, as discussed below, from the output of transformer 14.

Transformer 14 comprises a secondary winding 142 that steps-up the voltage from primary winding 140, for example, to about 45 to 65 volts, to provide power to arming circuit 16. Arming circuit 16 comprises a rectifier 160 connected to secondary winding 142 to provide a high-voltage, direct current output signal from transformer 14. The output of rectifier 160 charges a firing capacitor 162 that stores the high-voltage energy derived from the output of transformer 14.

Preferably, transformer 14 comprises another secondary winding 144 to step-up the voltage from primary winding 140, for example, to about 12 volts. A second rectifier 164 in arming circuit 16 is connected to secondary winding 144 and to the optional, normally open shunt relay 166, which closes in response to a signal from rectifier 164. Rectifier 164 is also operably connected to arm-enable switch 122 and controller 130 for power-enable switch 124 to provide internally generated high-voltage enable and arm command signals to these components in place of the external sources of these signals.

Detonator 18 is operably connected to arming circuit 16 through shunt relay 166, which is normally open and which closes upon receiving an output signal from transformer 14 via rectifier 164. Detonator 18 comprises an explosive bridgewire 180 or the like, and may be grounded through a fire switch 210 in firing circuit 20 so that high-voltage energy stored in the arming circuit can be discharged through detonator 18 to fire the detonator and thus detonate the explosive charge. Detonator 18 is a high-voltage detonator for which power source 12 has insufficient voltage to fire on its own.

Firing circuit 20 comprises a timer 212 or the like that derives power from the output of transformer 14, e.g., from the high-voltage arm command signal generated by rectifier 164. Timer 212 closes fire switch 210 after an appropriate interval following a predetermined event such as the initial receipt of an arm signal or the actuation of a pressure switch. Should transformer 14 cease to produce high-voltage output, the firing circuit will not be able to close fire switch 210 to fire the device.

Figure 2:
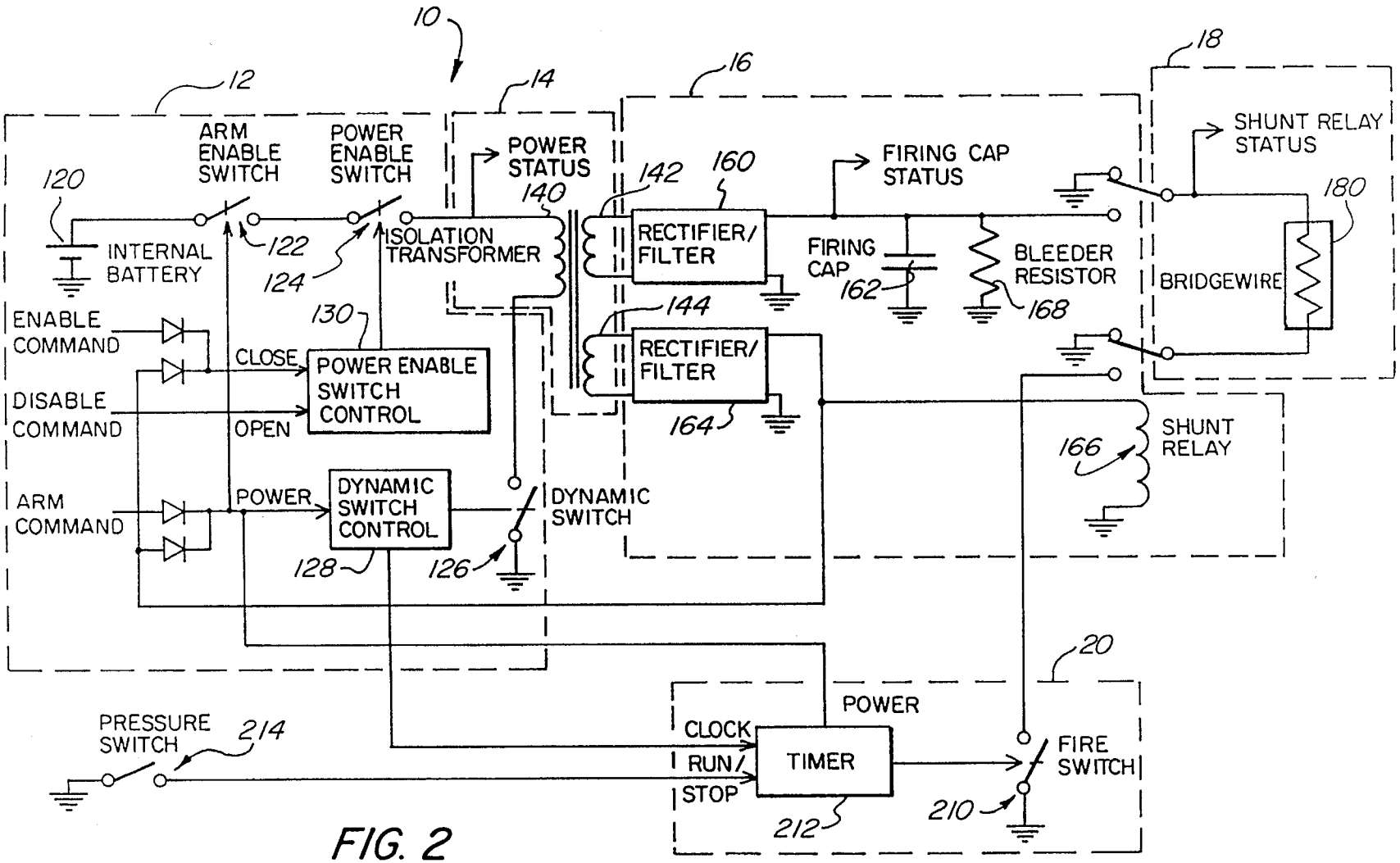
FIG. 2 is a schematic block diagram of the firing circuit of FIG. 1, with additional details shown therein.

Initially, the safe/arm circuit shown in FIG. 2 is in a safe dormant mode in which the internal power source 12 is disconnected from the transformer because arm-enable switch 122 and power-enable switch 124 are open. In addition, power source 12 is inoperable because dynamic switch 126 is open. Arming circuit 16 is uncharged, and detonator 18 is disconnected from the arming circuit because shunt relay 166 is open. Detonator 18 is also disconnected from the ground because fire switch 210 is open; so even if arming circuit 16 were charged it could not fire the device.

Two command signals are necessary to initiate the operation of the safe/arm circuit: an enable command and an arm command. The enable command is received by enable switch controller 130, which then closes power-enable switch 124. The arm command serves to close arm-enable switch 122, thus connecting internal battery 120 to primary winding 140 of transformer 14. The arm command also initiates and powers dynamic switch control 128, which periodically opens and closes dynamic switch 126 to provide periodic, low-voltage pulses from battery 120 through primary winding 140 of transformer 14. The initial arm command signal and enable command signal must be obtained from an external source, because in the dormant mode, battery 120 is not connected to transformer 14, so no internal arm or enable command signals can be generated by the device.

In other embodiments of the invention, either or both of arm-enable switch 122 and power-enable switch 124 may be omitted, so that the only external signal needed is the arm command for starting dynamic switch control 128. In still other embodiments, the power source may comprise a low-voltage AC power source that may be operably connected to the transformer by a normally open enable switch that requires a high-voltage enable signal from an external source before it closes to connect the power source to the transformer. After start-up the high-voltage output of the transformer can supply the signal required to keep the enable switch closed, as discussed below.

When the initial high-voltage enable and arm signals are provided, power source 12 operates to provide pulses of low-voltage current to the primary winding 140 of transformer 14 and the voltage is stepped-up by secondary winding 142. The output of transformer 14 is received by arming circuit 16 from secondary winding 142 through rectifier 160, which provides a signal having a voltage of about 45 to 65 volts, which is used to charge firing capacitor 162. The output of rectifier 164 is a signal of about 12 volts, which closes shunt relay 166, to connect detonator 18 to arming circuit 16, e.g., connecting bridgewire 180 to firing capacitor 162, thus preparing the device for firing. Thus, the internal, low-voltage periodic power source 12, although unable to fire detonator 18 or to charge the arming circuit 16 by itself, provides power through transformer 14 to charge arming circuit 16 to a high-voltage state sufficient to fire detonator 18.

The output of transformer 14 is also used to maintain the operation of the low-voltage periodic power source 12. Specifically, rectifier 164 derives power from secondary winding 144 of transformer 14, and supplies a continuing high-voltage enable command to controller 130, which keeps power-enable switch 124 closed. In addition, the output of transformer 14 is provided through rectifier 164 to supply a high-voltage arm command to arm-enable switch 122, which then remains closed. The arm command also causes dynamic switch control 128 to continue the periodic opening and closing of dynamic switch 126 so that low-voltage battery 120 continues to provide periodic low-voltage signals to transformer 14. Since the output of transformer 14 now provides all the signals necessary to keep internal battery 120 operably connected to transformer 14 and to operate dynamic switch 126, the external enable command and arm command can be removed once the device is initiated.

The firing operation is performed by firing circuit 20 by the closing of the normally open fire switch 210. In the illustrated embodiment, fire switch 210 is controlled by an optional timer 212 which derives its power from the high-voltage arm command provided from the output of transformer 14 through rectifier 164. Timer 212 may be responsive to the operation of dynamic switch control 128, to measure a suitable time period, e.g., 5 minutes, from the start of operation of dynamic switch 126 by dynamic switch control 128. The time period is chosen to be suitable for detonating the explosive charge after arming is commenced by the external arm command. Optionally, timer 212 may be responsive to an external trigger signal such as may be provided by a pressure switch 214, which may be employed as a trigger for a pressure-sensitive device, e.g., a land mine. In any event, upon passage of the appropriate time delay following a specified stimulus, timer 212 closes fire switch 210, allowing firing capacitor 162 to discharge through bridgewire 180, thus detonating the explosive charge.

Several safety features of the safe/arm device of the present invention are indicated in FIG. 2. For example, battery 120, being a low-voltage battery, is of insufficient voltage to fire bridgewire 180, or to sufficiently charge firing capacitor 162 in the event of a short circuit. Further, there are three (3) switches which must operate in response to external signal before the voltage of internal battery 120 can be stepped-up through transformer 14; these are arm-enable switch 122, power-enable switch 124, and dynamic switch 126. These three switches will only operate in response to high-voltage signals that cannot be obtained from battery 120 until the device receives two high-voltage start-up signals from an external source, i.e., an enable command and an arm command. Furthermore, the continued operation of the circuit requires the maintenance of these commands, which, after the external sources are removed, can only be provided from the output of transformer 14, as discussed above with respect to the output of rectifier 164. Accordingly, if the circuit is damaged, rectifier 164 may stop providing the arm and enable commands necessary for the operation of low-voltage power source 12. The absence of an arm command will force dynamic switch control 128 to leave dynamic switch 126 open, and will also open switches 122 and 124. Thus, the high-voltage output of transformer 14 will cease. In such case, even if firing capacitor 162 has a sufficent charge to inadvertently fire detonator 18, the charge will quickly be dissipated through bleeder resistor 168, leaving the circuit inoperable. Moreover, the absence of output from rectifier 164 will cause shunt relay 166 to open, disconnecting detonator 18 from arming circuit 16. Thus, the device may be rendered inoperative even before the arming circuit is depleted. Finally, even if the foregoing safety features do not function properly, the firing circuit 20, which must operate in order to discharge firing capacitor 162 through detonator 18, will cease to function in the absence of output from transformer 14 through rectifier 164.

As an additional safety feature, the power-enable switch controller 130 may optionally be responsive to a disable command, so that even if the circuit is charged and operating normally, a disable command will cause power enable switch 124 to open despite the continued receipt of an arm command from the output of rectifier 164. Of course, once power enable switch 124 opens, transformer 14 will become inactive and rectifier 164 will cease to provide an arm signal. As indicated above, the absence of an arm signal will disable the device in at least two ways, by opening arm-enable switch 122 and by ceasing the operation of dynamic switch 126. Preferably, power-enable switch controller 130 will be responsive to a subsequent enable command, so that even after the receipt of a disable command, the receipt of external arm command and enable commands can, if desired, re-initiate the arming and firing sequence.

Figure 3A:
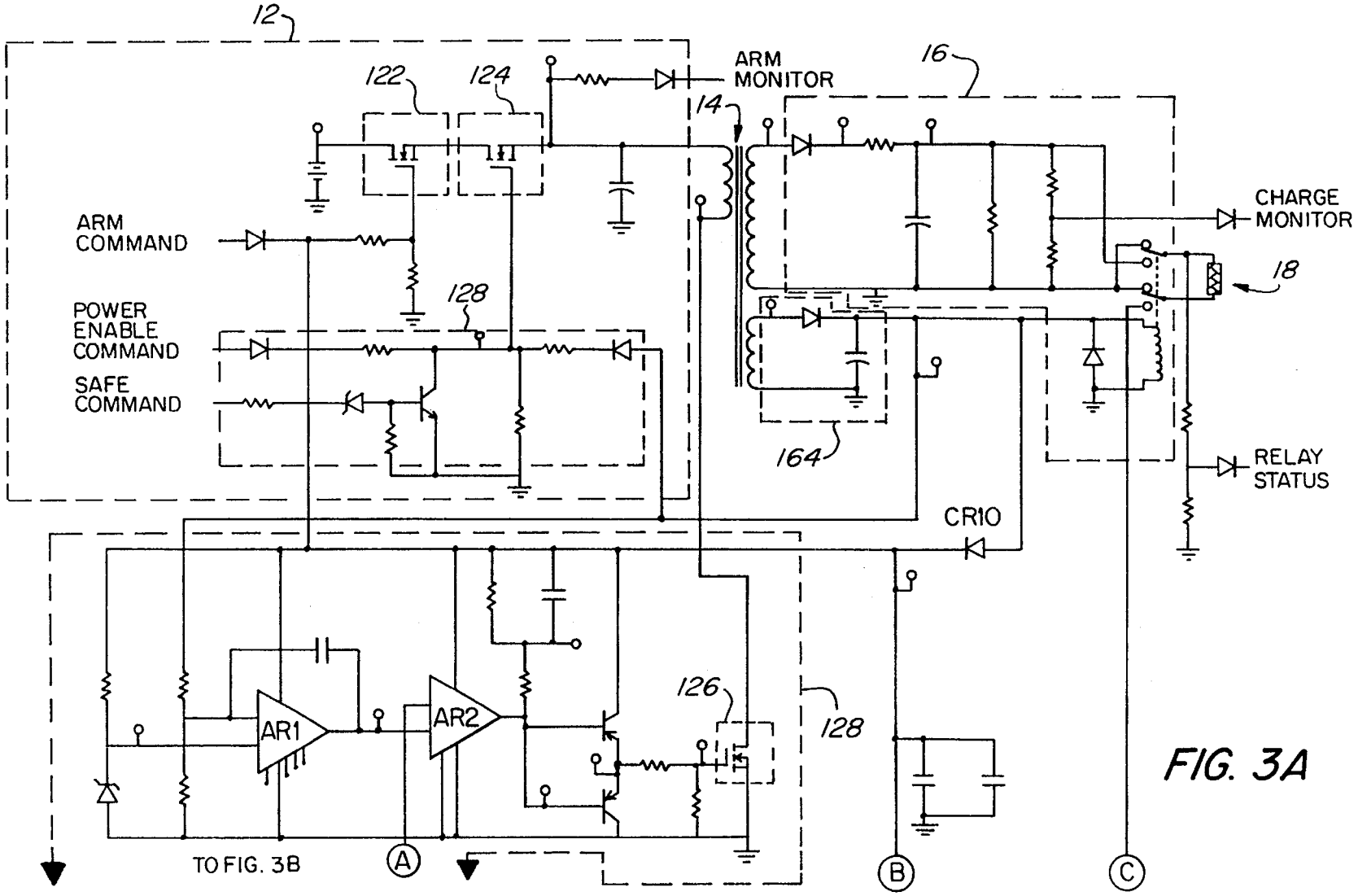
FIGS. 3A and 3B together are a schematic wiring diagram of a firing circuit according to a particular embodiment of the present invention.
Figure 3B:
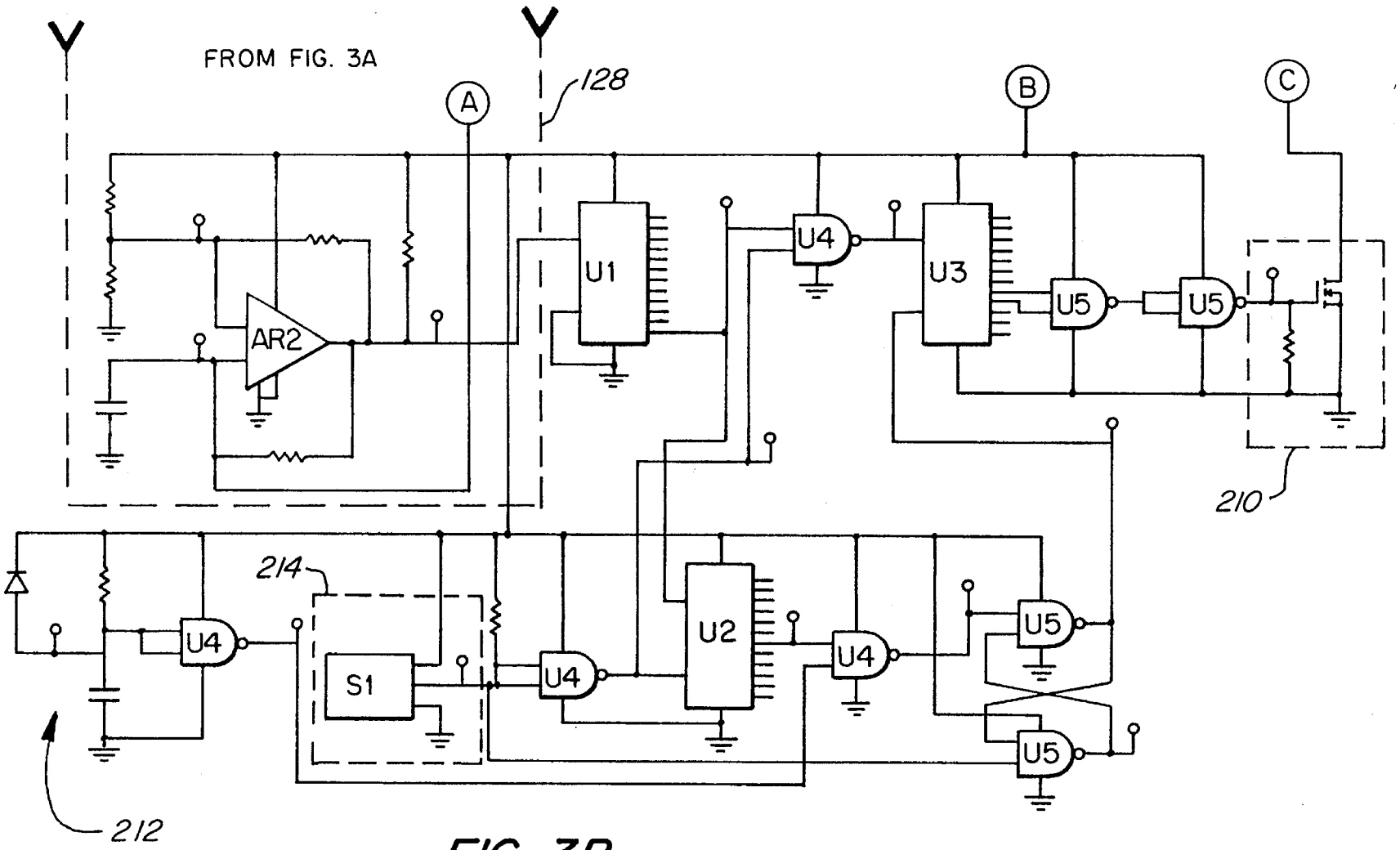

FIGS. 3A and 3B together show a schematic circuit diagram of a preferred embodiment of the present invention in which continuous connections between the Figures are indicated by the letters (A), (B) and (C). The components of dynamic switch control 128 include an operational amplifier AR1 and two comparitors AR2. In FIG. 3B, those portions of the circuit other than dynamic switch control 128, fire switch 210 and pressure switch 214 constitute timer 212. As can be seen, timer 212, which controls fire switch 210, is powered from the output of transformer 14 through rectifier/filter 164, diode CR10, and the connection broken at (B). The integrated circuits labeled as U1, U2 and U3 in FIG. 3B, are counters; those labelled U4 and U5 are conventional NAND logic gates.

Transformer 14, as shown in the accompanying Figures, provides direct current isolation between the low-voltage periodic power source and the detonator. Therefore, by properly insulating the power source, an additional measure of safety can be attained in preventing inadvertent short circuits between the power source and the detonator. In addition, the circuits shown above provide a fail-safe mechanism in that the dynamic switch control must operate properly to provide power to maintain the charge in the firing capacitor. Should the circuit be damaged and the dynamic switch control fail, the device will quickly become disabled. Further safety is provided since the internal battery is of insufficient voltage to provide the arm signal, the enable signal, to fire the detonator, to charge the capacitor sufficiently to fire the detonator or to operate the dynamic arm switch control circuit. Further safety features are realized because two independent commands, the enable command and the arm command, must initially be supplied from an external source and because the detonator, e.g., the bridgewire, is disconnected from the arming circuit until output is available from the step-up transformer.

While the invention has been described in detailed with reference to a particular embodiment thereof, it will be apparent that upon a reading and understanding of the foregoing, numerous alterations to the described embodiment will occur to those skilled in the art and it is intended to include such alterations within the scope of the appended claims.

What is claimed is:

1. An electronic safe/arm device comprising:

an internal, low-voltage, periodic power means for providing periodic pulses of low-voltage electricity;

a transformer comprising a primary winding operably connected to the periodic power means and comprising at least one secondary winding for producing output voltage from the periodic pulses in the primary winding, including high-voltage AC power;

a high-voltage arming means operably connected to the at least one secondary winding of the transformer, for storing high-voltage electrical energy from the transformer for use in firing high-voltage detonator;

a high-voltage detonator operably connected to the arming means through relay means for connecting the detonator to the arming means in response to power output from the transformer and for disconnecting the detonator from the arming means in the absence of output from the transformer; and a firing means powered from the output of the transformer, for firing the detonator after the arming means is charged by the transformer, by discharging to the detonator the energy stored in the arming means.

2. An electronic safe/arm device comprising:

an internal, low-voltage, periodic power means for providing periodic pulses of low-voltage electricity;

a transformer comprising a primary winding operably connected to the periodic power means and comprising at least one secondary winding for producing output voltage from the periodic pulses in the primary winding, including high-voltage AC power;

a high-voltage arming means operably connected to the at least one secondary winding of the transformer, for storing high-voltage electrical energy from the transformer for use in firing a high-voltage detonator;

a high-voltage detonator operably connected to the arming means; and a firing means powered from the output of the transformer, for firing the detonator after the arming means is charged by the transformer, by discharging to the detonator the energy stored in the arming means;

wherein the periodic power means comprises an enabling means for operably connecting the periodic power means to the primary winding of the transformer in response to output from the transformer and for subsequently operably disconnecting the periodic power means from the primary winding to prevent the periodic power means from discharging through the transformer upon at least one of (a) the receipt of a disarm signal and (b) the absence of output from the transformer.

3. The device of claim 1 or claim 2 wherein the periodic power means comprises a low-voltage battery means and a dynamic switch means for periodically discharging the low-voltage battery means through the primary winding in response to at least one of (a) an arm signal from an external source and (b) the output of the transformer.

4. The device of claim 3 wherein the arming means comprises signal-generating means powered from a secondary winding of the transformer and operably connected to at least one of the enabling means and the dynamic switch means, for producing at least one of an arm signal and an enable signal.

5. The device of claim 1 or claim 3 wherein the firing means comprises a timer means that is responsive to at least one of an arm signal and a trigger signal, for measuring a predetermined delay period following one of the arm signal and the trigger signal and for issuing a signal thereafter, and wherein the firing means fires the detonator in response to the signal from the timer means.

6. The device of claim 5 further comprising a pressure switch for providing a trigger signal to the timer means.

7. The device of claim 1 or claim 2 wherein the arming means comprises a high-voltage capacitor operably connected to the detonator.

8. The device of claim 2 wherein the arming means comprises relay means for connecting the detonator to the arming means in response to power output from the transformer and for disconnecting the detonator from the arming means in the absence of output from the transformer.

9. An electronic safe/arm device comprising:

an internal, low voltage, battery means;

a transformer operably connected to the battery means, the transformer comprising a primary winding and at least one secondary winding for producing output voltage including high-voltage AC power from low-voltage pulses in the primary winding;

a dynamic switch means for periodically discharging the battery means through the primary winding in response to an arm signal, and for stopping the periodic discharge in the absence of an arm signal;

an internal signal-generating means powered from the output of the transformer and operably connected to the dynamic switch means, for producing at least an arm signal;

a high-voltage arming means operably connected to the at least one secondary winding of the transformer, for storing high-voltage energy from the transformer;

a high-voltage detonator operably connected to the arming means;

a firing means powered from the internal arm signal means for discharging the arming means through the detonator after a predetermined delay following an at least one of arm signal and a trigger signal; and power-enable means for operably connecting the battery means to the transformer in response to an enable signal, and for stopping the periodic discharge of the battery means to the primary winding of the transformer upon at least one of (a) the absence of enable signal, and (b) the receipt of a disarm signal.

10. The device of claim 9 wherein the power-enable means is responsive to an enable signal that follows a disable signal, to allow the periodic discharge of the battery means through the primary winding of the transformer to resume after such discharge has been stopped due to the receipt of the disarm signal.

11. The device of claim 9 wherein the detonator is connected to the arming means by a normally open relay that closes in response to the arm signal from the signal-generating means.

12. The device of claim 9 wherein the internal signal-generating means is operably connected to the power-enable means, for providing an enable signal to the power-enable means from the output of the transformer.

* * * * *

UNITED STATES PATENT AND TRADEMARK OFFICE

CERTIFICATE OF CORRECTION

PATENT NO. : 5,476,044
DATED : December 19, 1995
INVENTOR(S) : Craig J. Boucher

It is certified that error appears in the above-indentified patent and that said Letters Patent is hereby corrected as shown below:

In column 2, line 3, after "firing means" insert --is--.

In claim 1, column 8, line 43, after "firing" insert --a--.

In claim 9, column 10, line 22, delete "an";

line 23, after "least one of" insert --an--.

Signed and Sealed this

Thirtieth Day of July, 1996

*Attest:*

Bruce Lehman

BRUCE LEHMAN

*Attesting Officer*

*Commissioner of Patents and Trademarks*